US007900816B2

(12) United States Patent
Kastanek et al.

(10) Patent No.: US 7,900,816 B2
(45) Date of Patent: Mar. 8, 2011

(54) COLLAPSIBLE COOLER PACK WITH BARRIER FILM

(75) Inventors: Raymond S. Kastanek, Longmont, CO (US); Dale F. Nicholls, Evergreen, CO (US); Weston R. Wilson, Arvada, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 1057 days.

(21) Appl. No.: 11/612,103

(22) Filed: Dec. 18, 2006

(65) Prior Publication Data

US 2007/0137222 A1 Jun. 21, 2007

Related U.S. Application Data

(60) Provisional application No. 60/751,363, filed on Dec. 16, 2005.

(51) Int. Cl.
*B65D 81/38* (2006.01)

(52) U.S. Cl. ..... 229/117.13; 220/592.2; 220/739

(58) Field of Classification Search ..... 229/117.13, 229/117.34, 117.33, 117.27; 220/592.26, 220/739

See application file for complete search history.

(56) References Cited

U.S. PATENT DOCUMENTS

| | | | | |
|---|---|---|---|---|
| 2,337,039 | A | 12/1943 | Gardner, Jr. et al. | |
| 2,810,506 | A | 10/1957 | Kessler | |
| 2,868,433 | A | 1/1959 | Anderson, Jr. | |
| 2,955,739 | A | 10/1960 | Collura | |
| 3,071,304 | A * | 1/1963 | Brastad | 229/117.32 |
| 3,112,856 | A | 12/1963 | MacIntosh et al. | |
| 4,036,423 | A | 7/1977 | Gordon | |
| 4,328,923 | A | 5/1982 | Graser | |
| 4,378,905 | A | 4/1983 | Roccaforte | |
| 4,498,619 | A | 2/1985 | Roccaforte | |
| 4,530,459 | A * | 7/1985 | Maroszek | 229/117.15 |
| 4,546,914 | A | 10/1985 | Roccaforte | |
| 4,588,084 | A | 5/1986 | Holley, Jr. | |
| 4,712,726 | A | 12/1987 | Fonas | |
| 5,020,337 | A | 6/1991 | Krieg | |
| 5,292,058 | A | 3/1994 | Zoss et al. | |
| 5,495,727 | A | 3/1996 | Strong et al. | |
| 5,582,343 | A | 12/1996 | Dalvey | |
| 5,639,017 | A | 6/1997 | Fogle | |
| 5,794,778 | A | 8/1998 | Harris | |
| 5,873,515 | A | 2/1999 | Dunn et al. | |
| 5,915,546 | A | 6/1999 | Harrelson | |
| 5,992,733 | A | 11/1999 | Gomes | |
| 6,065,590 | A | 5/2000 | Spivey | |
| 6,164,526 | A | 12/2000 | Dalvey | |
| 6,631,803 | B2 * | 10/2003 | Rhodes et al. | 206/427 |

(Continued)

FOREIGN PATENT DOCUMENTS

WO WO 2007/089282 8/2007

*Primary Examiner* — Gary E Elkins
*Assistant Examiner* — Christopher Demeree
(74) *Attorney, Agent, or Firm* — Womble Carlyle Sandridge & Rice, PLLC

(57) ABSTRACT

A collapsible cooler pack carton includes a barrier film on the cooler pack interior capable of retaining liquids in the cooler pack. The blank used to form the cooler pack can be provided with the barrier film and shipped or displayed as a flat partially assembled cooler pack article. A consumer or other user can assemble the cooler pack from the article. After use, the user can disassemble or collapse the cooler pack back into the partially assembled or collapsed cooler pack article.

24 Claims, 10 Drawing Sheets

U.S. PATENT DOCUMENTS

| | | | | |
|---|---|---|---|---|
| 6,926,193 | B2 | 8/2005 | Smalley | |
| 6,945,450 | B2 * | 9/2005 | Rusnock | 229/243 |
| 2004/0004111 | A1 | 1/2004 | Cardinale | |
| 2006/0091190 | A1 * | 5/2006 | Nikolai | 229/117.14 |
| 2006/0273143 | A1 | 12/2006 | Finch | |
| 2007/0051781 | A1 | 3/2007 | Holley et al. | |

* cited by examiner

COLLAPSIBLE COOLER PACK WITH BARRIER FILM

CROSS-REFERENCE TO RELATED APPLICATIONS

This application claims the benefit of U.S. Provisional Application No. 60/751,363, filed Dec. 16, 2005, which is hereby incorporated by reference in its entirety.

BACKGROUND

It is well known to use ice to cool, for example, beverages. Traditional coolers having insulated sidewalls and an insulated lid are typically shipped and sold in a fully-assembled configuration. Generally, the insulated sidewalls of a standard cooler are semi-rigid and cannot be collapsed to place the cooler in a flattened configuration for shipping or handling. Although some soft-sided coolers have been manufactured, they too have disadvantages. Existing soft-sided coolers do not pack as flat as may be desired, and they are relatively expensive. Thus, it remains desirable to have a relatively inexpensive, collapsible cooler.

SUMMARY

According to one aspect of the present invention, a collapsible cooler pack carton includes a barrier film in the cooler pack interior. The barrier film is formed into a vessel that is capable of retaining liquid, such as runoff from melting ice, etc., within the cooler pack. The cooler pack can be formed from a collapsed or substantially flat cooler pack article that can be assembled prior to use, and disassembled or collapsed after use.

Other aspects, features, details, utilities, and advantages of the present invention will be apparent from reading the following description and from reviewing the accompanying drawings.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present embodiments are addressed to reusable, collapsible cooler packs 10, 10' (see, e.g., FIGS. 10 and 15, respectively) having a barrier film 122 (see, e.g., FIGS. 2-5) mounted to their interior surfaces. The barrier films 122 retain fluid resulting from, for example, melting ice, e.g., that may be used to cool beverage containers, food items, or other items stored in the cooler packs. According to one aspect of the present invention, the barrier film 122 is attached to the interior surface of a blank 12, 12'. The barrier film 122 is then sealed (see, e.g., FIG. 3), creating, in effect, a liquid-tight vessel, such as a "bag," within the folded and glued blank 12, 12'. After the liquid-tight vessel is formed and while the film/blank combination is still collapsed and generally flat, the cooler pack article may be shipped to a location for distribution to a consumer or retailer, etc. The consumer later forms or erects the cooler pack article into a substantially parallelepipedal cooler pack. When the cooler pack is no longer needed, the consumer may partially disassemble or collapse the cooler pack into an easily stored and transported generally flat configuration.

Figure 1:
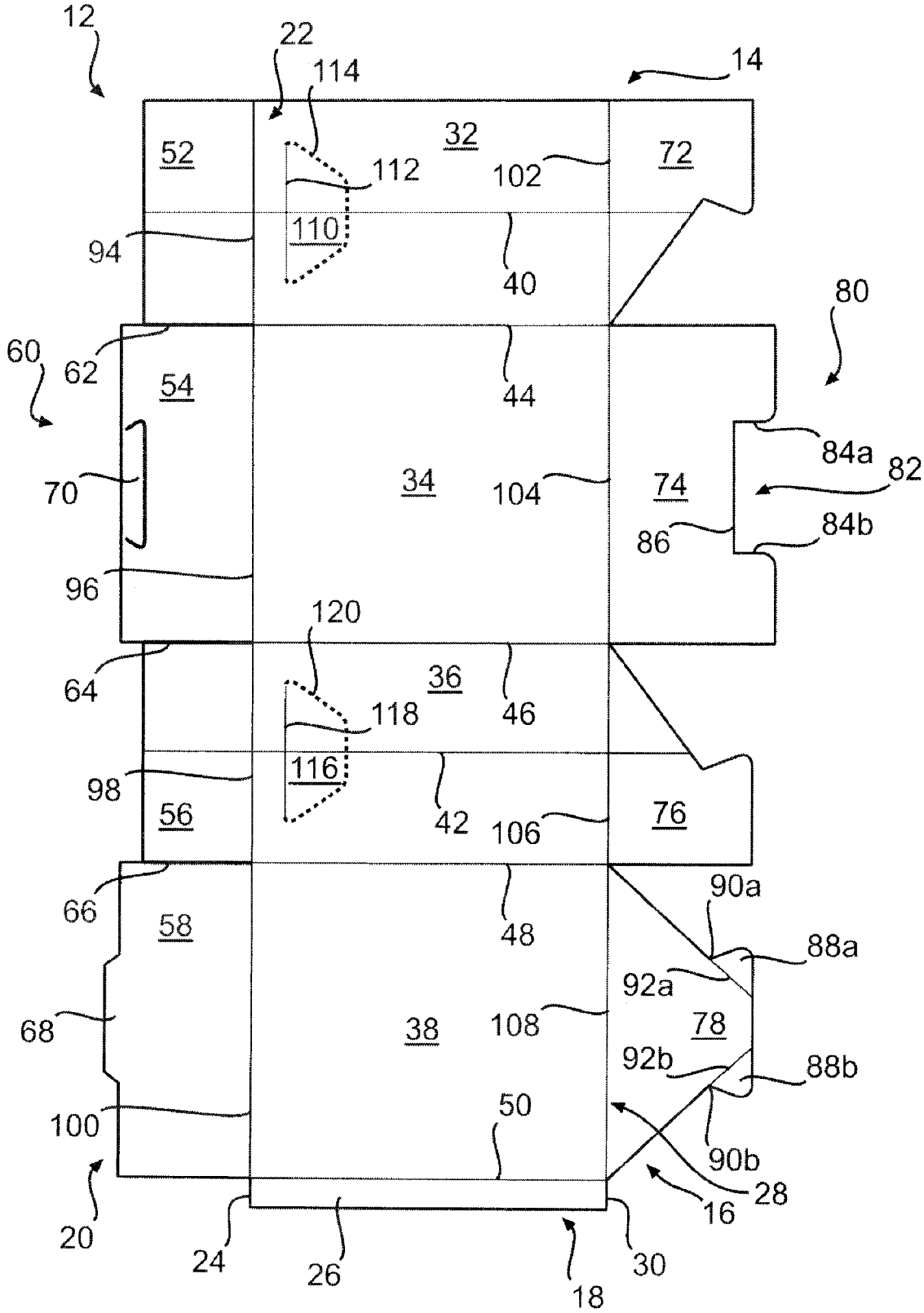
FIG. 1 illustrates a first blank from which a collapsible cooler pack according to a first embodiment of the present invention may be assembled.

FIG. 1 illustrates a first blank 12 used to construct a cooler pack 10 (FIG. 10) according to a first embodiment of the invention. The overall perimeter of the first blank 12 is defined by a first side panel free edge 14, a blank lower edge 16, a glue seam free edge 18, and a blank upper edge 20. An upper fold line 22 extends substantially perpendicularly between the first side panel free edge 14 and the edge of the blank adjacent to an upper edge 24 of a glue seam 26. A lower fold line 28 similarly extends substantially perpendicularly between the first side panel free edge 14 and a lower edge 30 of the glue seam 26.

The blank 12 includes a first side panel 32, a front panel 34, a second side panel 36, and a rear panel 38. The first side panel 32 is bisected by a first false score fold line 40, and the second side panel 36 is bisected by a second false score fold line 42. A first front panel fold line 44 separates the first side panel 32 from the front panel 34, and a second front panel fold line 46 separates the front panel 34 from the second side panel 36. Similarly, a first rear panel fold line 48 separates the second side panel 36 from the rear panel 38, and a second rear panel fold line 50 separates the rear panel 38 from the glue seam 26. The fold lines 22, 28 extend longitudinally along a length of the blank 12, and the lines 40, 44, 46, 48, 50 extend transversely across a width of the blank 12.

Four panels are formed in a first or upper marginal area of the blank 12, between the upper fold line 22 and the blank upper edge 20, including a first side panel top flap 52, a front panel top flap 54, a second side panel top flap 56, and a rear panel top flap 58. The top panels 52, 54, 56, 58 together comprise a tuck-top closure 60 for the top of the assembled cooler pack 10 as discussed further below. A first transverse score line 62 is present between the first side panel top flap 52 and the front panel top flap 54. A second transverse score line 64 is present between the front panel top flap 54 and the second side panel top flap 56. A third transverse score line 66 is present between the second side panel top flap 56 and the rear panel top flap 58. In order to facilitate easy opening and closing of the top end of the formed cooler pack 10 (FIG. 10), a closing tab 68 extends from the rear panel top flap 58 and a corresponding closing tab slot 70 is formed in the front panel top flap 54.

Four panels are formed in a second or lower marginal area of the blank 12, between the lower fold line 28 and the blank lower edge 16, including a first side panel bottom flap 72, a main bottom flap 74, a second side panel bottom flap 76, and a bottom locking flap 78. The panels 72, 74, 76, 78 together comprise a snap-lock bottom 80, which is also known as a Houghton bottom or a 1-2-3 bottom. The main bottom flap 74 includes a retention notch 82 defined by a pair of retention notch sidewalls 84*a*, 84*b* and a retention notch bottom wall 86. The bottom locking flap 78 includes a pair of locking tabs 88*a*, 88*b*, each of which defines a shoulder 90*a*, 90*b* that helps hold the bottom 80 closed as described further below. A locking tab fold line 92*a*, 92*b* may also be present on the bottom locking flap 78.

The upper longitudinal fold line 22 comprises four primary segments: a first side panel top flap hinge line 94, a front panel top flap hinge line 96, a second side panel top flap hinge line 98, and a rear panel top flap hinge line 100. Similarly, the lower fold line 28 also comprises four primary segments: a first side panel bottom flap hinge line 102, a main bottom flap hinge line 104, a second side panel bottom flap hinge line 106, and a bottom locking flap hinge line 108.

In order to facilitate carrying of the cooler pack 10 that may be erected from the blank 12, one or more handles may also be formed in the blank 12. For example, the blank 12 includes a first fold-in handle panel 110 defined by a handle panel hinge line 112 and a first handle panel score line 114. A second fold-in handle panel 116 is defined in the second side panel 36 by a second handle panel hinge line 118 and a second handle panel score line 120. Once the cooler pack 10 is assembled as described further below, pressure is applied to the handle panels 110, 116 causing the handle panel score lines 114, 120, respectively, to be breached and the handle panels 110, 116 to fold about the handle panel hinge lines 112, 118, respectively. The handle panels 110, 116 may provide some cushioning for a consumer's hands as they carry the cooler pack 10.

An exemplary method of forming a partially-formed or assembled cooler pack article 11 from the blank 10 is discussed in detail below with reference to FIGS. 1, 2 and 3.

Figure 2:
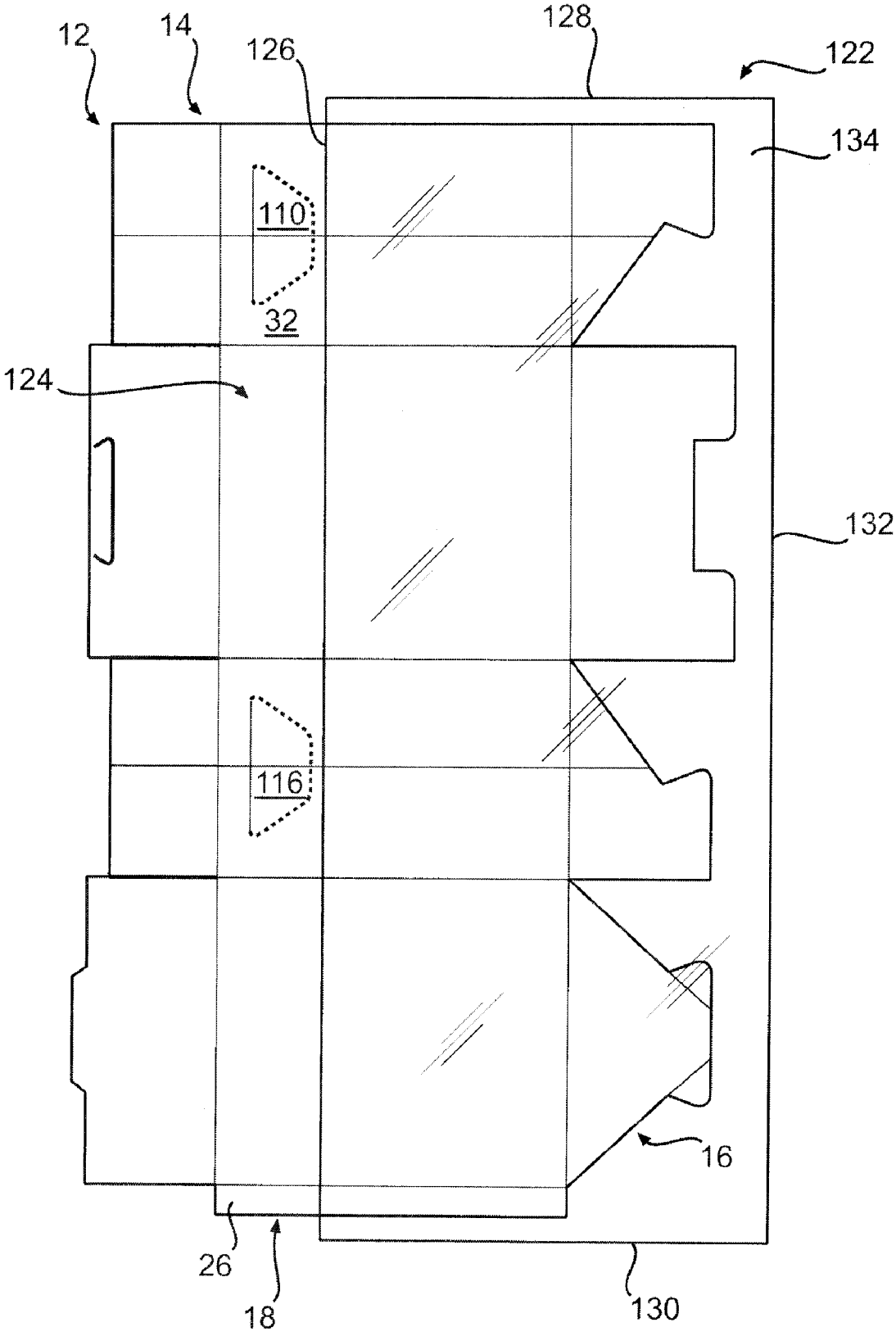
FIG. 2 illustrates the blank from FIG. 1 with a barrier film attached thereto.

Referring to FIGS. 1 and 2, a liquid-impervious barrier film 122 is affixed to a surface 124 of the blank 12 that will become an interior surface of the formed cooler pack 10. The barrier film 122 can be secured to the surface 124 by, for example, glue, other adhesives, and by other means. The barrier film 122 can be formed from, for example, a liquid-impervious material. As illustrated in FIG. 2, the barrier film 122 may be positioned on the surface 124 with its upper edge 126 below the first and second handle panels 110, 116 so that it does not interfere with their usage. The barrier film 122 includes a first free edge 128 that extends beyond the first side panel free edge 14 of the blank 12, and a second free edge 130 that extends beyond the glue seam free edge 18 of the blank 12. The barrier film 122 also includes a lower edge 132 which extends beyond the blank lower edge 16 creating an overhanging portion 134 of barrier film 122.

After forming the intermediate blank/barrier film configuration illustrated in FIG. 2, the glue seam 26 is glued to the interior surface 124 of the first side panel 32 adjacent to the first side panel free edge 14, creating an open-ended outer sleeve. Simultaneously or subsequently, the first free edge 128 of the barrier film 122 is attached to the second free edge 130 of the barrier film 122, creating an open-ended inner sleeve of the barrier film 122 within the open-ended outer sleeve created by the blank 12. The illustrated configuration may be formed using, for example, straight-line-gluing.

Figure 3:
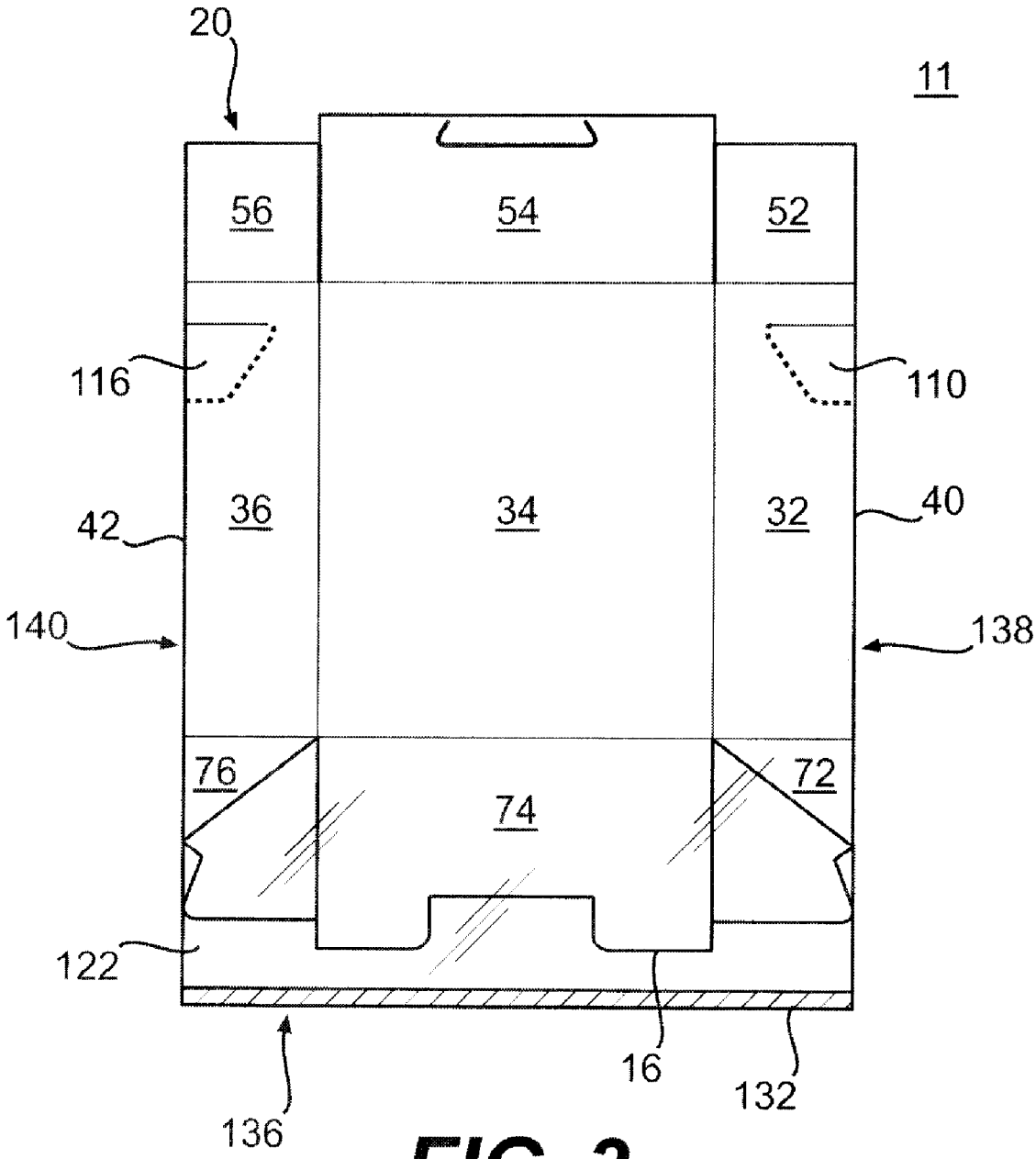
FIG. 3 illustrates a partially assembled cooler pack article formed from the blank and barrier film combination of FIG. 2.
Figure 4:
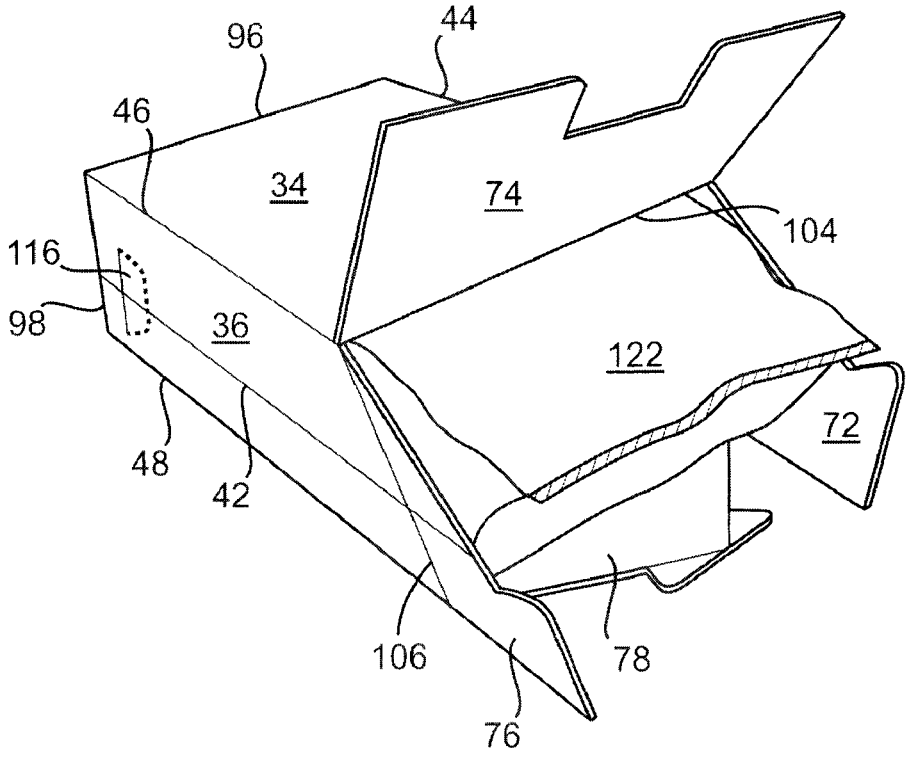
FIGS. 4-9 illustrate a method for forming the partially assembled cooler pack article illustrated in FIG. 3 into the cooler pack according to the first embodiment of the invention.

Referring to FIG. 3, after forming the open-ended outer sleeve with its open-ended barrier film sleeve, the barrier film 122 and blank 12 assembly is folded along the first false score fold line 40 and along the second false score fold line 42, placing the front panel 34 on top of the rear panel 38 with only two layers of barrier film separating them. While the blank and barrier film assembly is held in this flattened configuration, the lower edge 132 of the barrier film 122 is sealed upon itself. The lower edge 132 can be sealed using, for example, hot air or a band sealer, creating a sealed end 136 and thereby forming what is essentially a barrier film vessel or bag within the folded and glued blank 12. The vessel may be least tacked by adhesive to the interior surface 124 of the folded blank 12, but need not be. If a very pliable material is used for the barrier film 122, the first and second false score fold lines 40, 42 may be unnecessary.

The resulting partially assembled cooler pack article 11 illustrated in FIG. 3 comprises the blank 12 collapsed on its first and second fold lines 40, 42 and the barrier film 122 sealed along its lower edge 132. In the flattened configuration, the article 11 occupies minimal space in a shipping or storage container, on a display shelf, or in a potential end user's possession. In the partially assembled configuration, the article 11 may be, for example, displayed for purchase by a consumer in a convenience store, a grocery store, a gas station, or any other location where a consumer may be interested in purchasing such a product.

An exemplary method of forming the cooler pack 10 from the article 11 is discussed below with reference to FIGS. 3-10.

Figure 5:
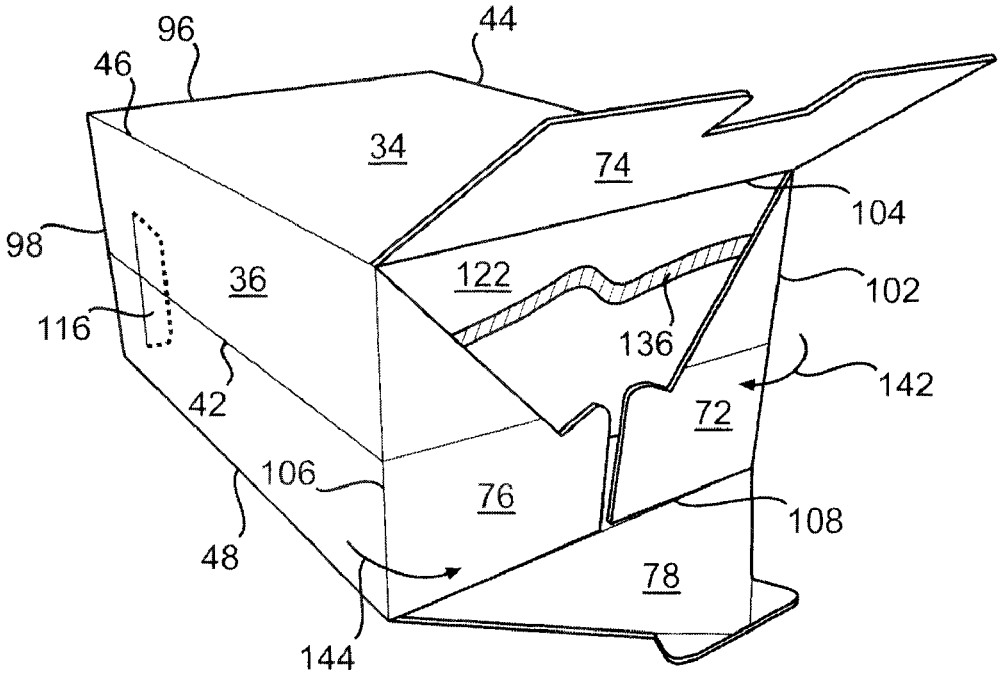
Figure 6:
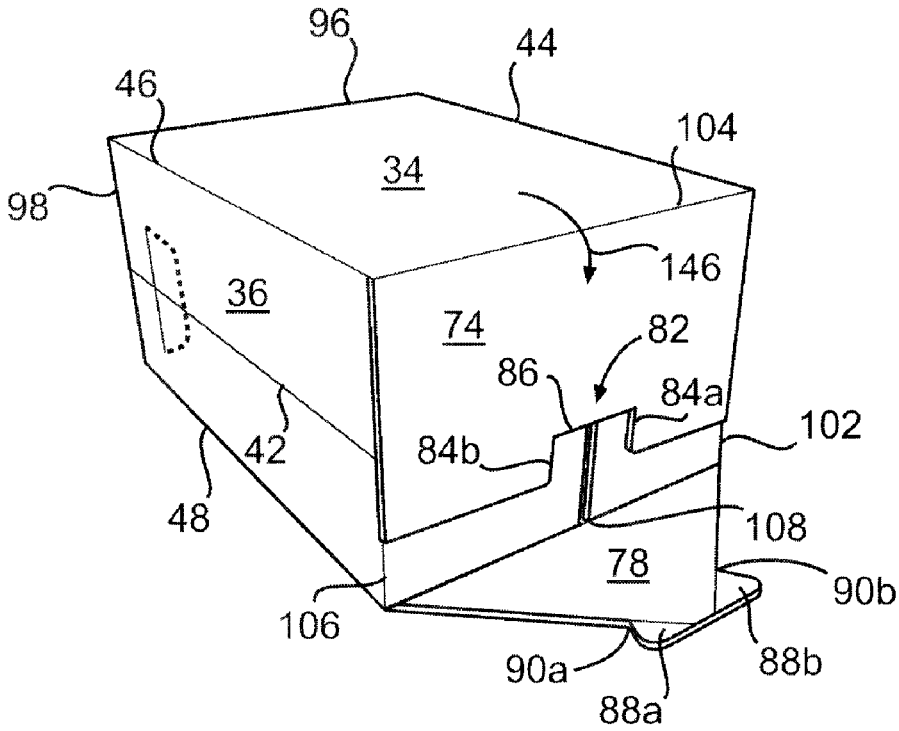

When it is time to use or display or otherwise utilize the cooler pack 10 in a fully assembled configuration, the bottom 80 and top 60 of the cooler pack 10 may be constructed. Referring to FIG. 3, pressure is applied inwardly in the direction of arrows 138, 140 along the first and second false score fold lines 40, 42, respectively, resulting in the open-ended, generally tubular configuration of FIG. 4. Referring to FIG. 5, the barrier film 122 is then pushed into the interior of the partially formed cooler pack, allowing the first side panel bottom flap 72 and the second side panel bottom flap 76 to be folded inwardly in the direction of the arrows 142, 144. Referring to FIG. 6, the main bottom flap 74 may then be folded in the direction of the arrow 146.

Figure 7:
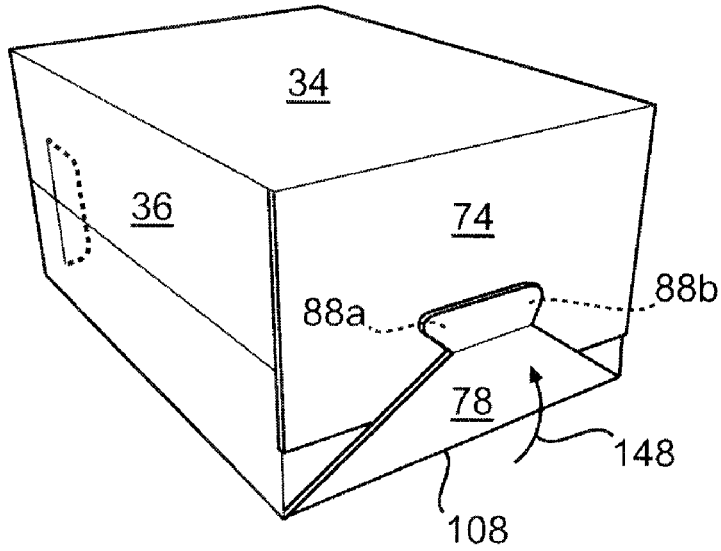

Referring to FIGS. 6 and 7, the bottom locking flap 78 may be folded in the direction of the arrow 148, and the locking tabs 88*a*, 88*b* inserted behind the main bottom flap 74 between the sidewalls 84*a*, 84*b*. When the bottom locking flap 78 is engaged with the retention notch 82 on the main bottom flap 74, each shoulder 90*a*, 90*b* of the bottom locking flap 78 rides in one of the corners formed at the intersection of the retention notch bottom wall 86 and one of the retention notch side walls 84*a*, 84*b*. The cooler pack is then placed on its closed bottom 80 so that product (e.g., beverages) that the user wants to cool or store can be placed into the open top end of the partially assembled cooler pack.

Figure 8:
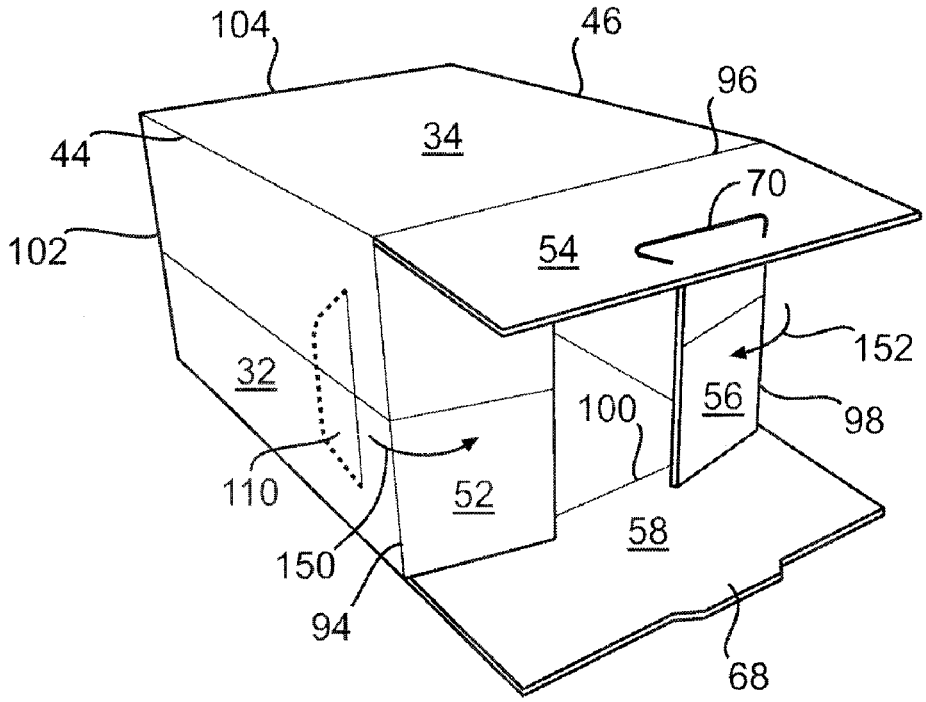
Figure 9:
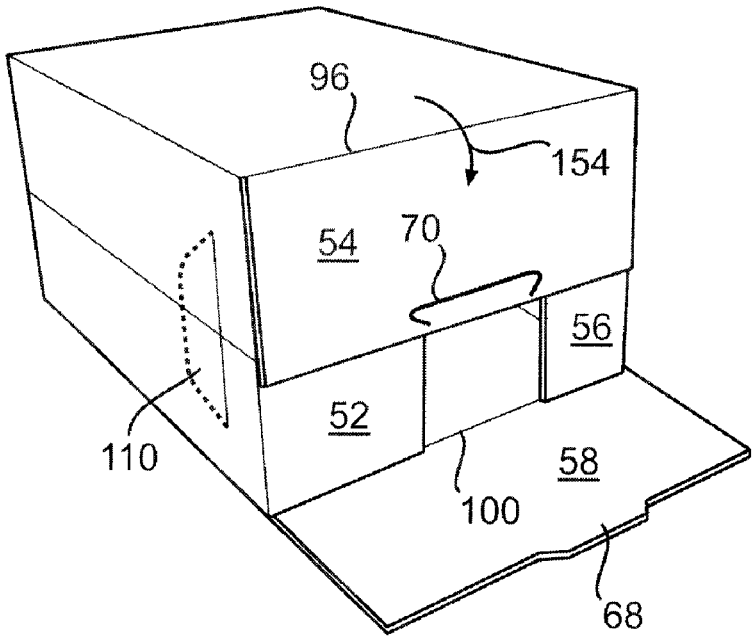
Figure 10:
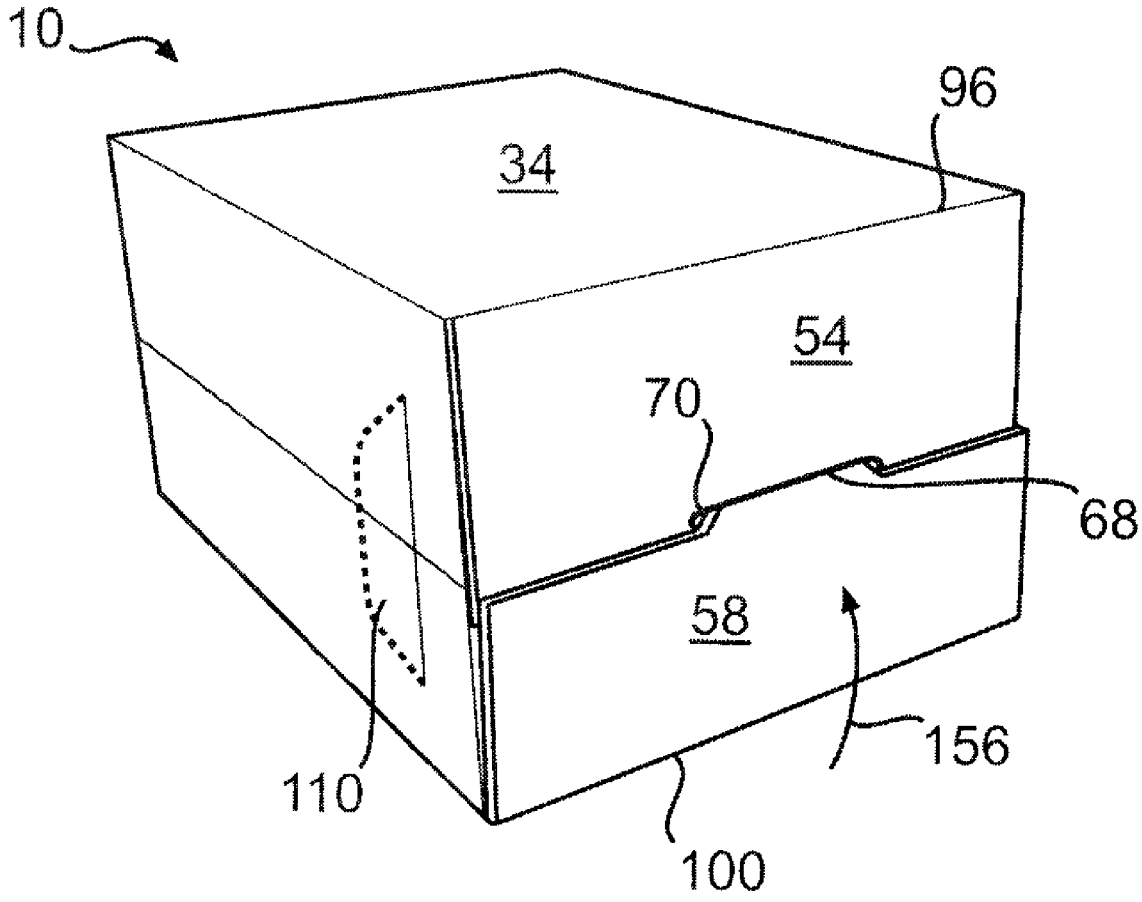
FIG. 10 illustrates the cooler pack according to the first embodiment of the invention.

FIGS. 8-10 illustrate closing of the top end of the cooler pack. Referring to FIG. 8, the first side panel top flap 52 and the second side panel top flap 56 are folded inwardly in the direction of the arrows 150, 152, respectively. The first side panel top flap 52 folds along the first side panel top flap hinge line 94, and the second side panel top flap 56 folds along the second side panel top flap hinge line 98. Referring to FIG. 9, the front panel top flap 54 is folded along the front panel top flap hinge line 96 over the first and second side panel top flaps 52, 56, respectively, in the direction of the arrow 154. Referring to FIG. 10, the rear panel top flap 58 is folded along the rear panel top flap hinge line 100 in the direction of the arrow 156. To help ensure that the cooler pack 10 remains closed when desired, the closing tab 68 may be, for example, inserted into the closing tab slot 70 at the top of the cooler pack. With the top of the cooler pack 10 closed, the cooler pack 10 has a generally parallelepipedal shape.

In use, the cooler pack 10 may be filled with food items, beverage bottles, cans, or other containers. The top of the cooler pack 10 is reclosably closed so that items may be loaded into and out of the cooler pack 10 when desired. Ice, for example, may be placed in the cooler pack 10 along with beverage containers. The ice cools the beverage containers, and after the beverages have been consumed, the user can empty remaining ice and water runoff from the ice from the vessel. The bottom and top of the cooler pack 10 can be opened by disengaging the bottom and top flaps. The cooler pack 10 can then be collapsed into the substantially flat cooler pack article 11 illustrated in FIG. 3.

Figure 11:
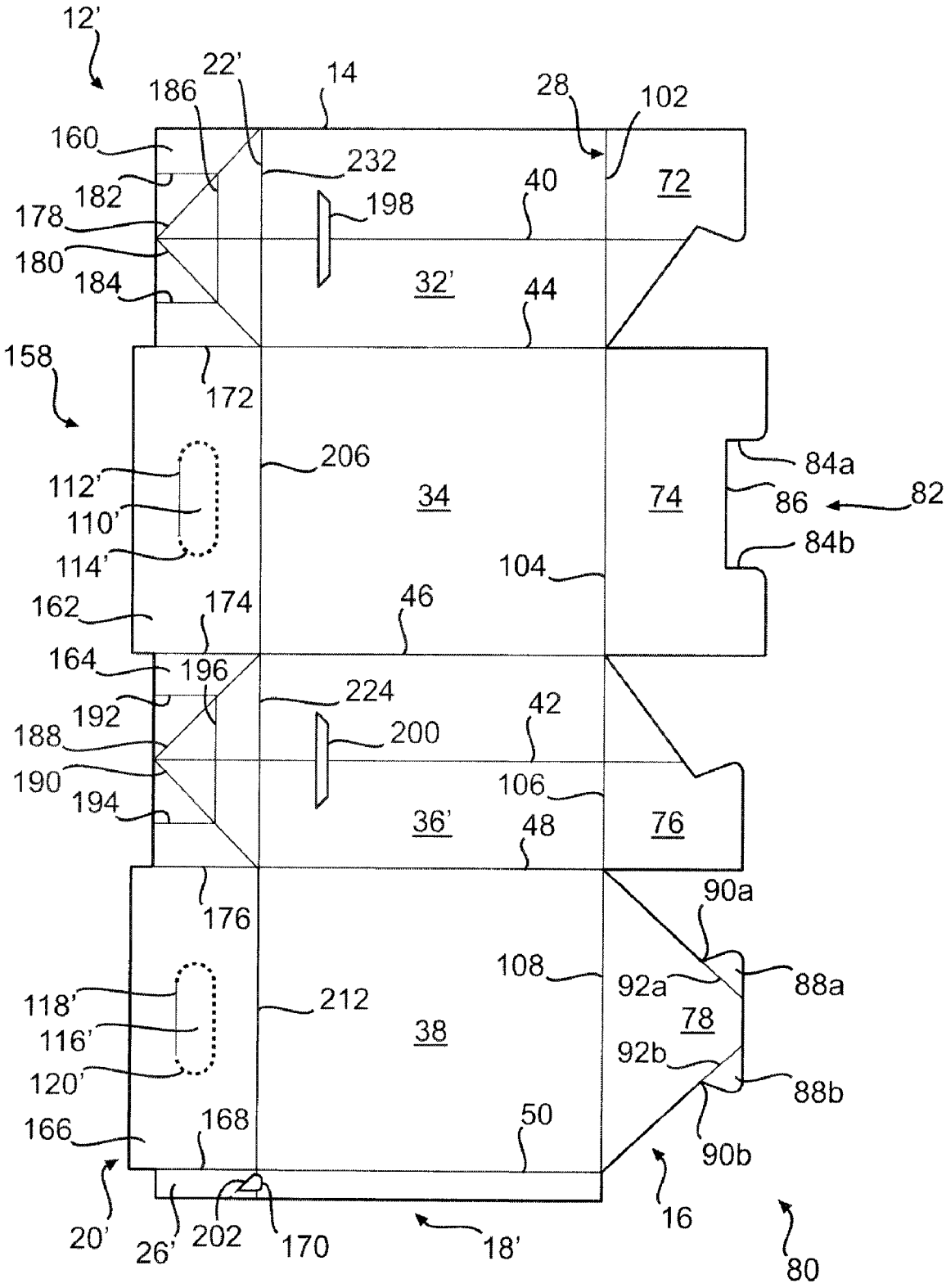
FIG. 11 illustrates a blank from which a collapsible cooler pack according to a second embodiment of the present invention may be assembled.

FIG. 11 illustrates a blank 12' that may be used to form a cooler pack 10' (illustrated in FIG. 15) according to a second embodiment of the present invention. The second blank 12' is similar in construction to the blank 12 illustrated in FIG. 1, and like or similar reference numbers in FIGS. 1 and 11 indicate like or similar elements.

The blank 12' has a snap-lock bottom 80 similar to the blank 10. The top, however, includes a webbed-top closure 158 rather than a tuck-top closure 60 as illustrated in FIG. 1. The webbed-top closure 158 comprises a continuous panel located in a first or upper marginal area of the blank 12', between the upper longitudinal fold line 22' and the blank upper edge 20'. The continuous panel comprises a first side panel tuckable flap 160, a front panel top flap 162, a second side panel tuckable flap 164, and a rear panel top flap 166. The second blank 12' also includes a longer glue seam 26' than the glue seam 26 illustrated in FIG. 1. The longer glue seam 26' extends partially along one edge of the rear panel top flap 166 along a first upper hinge line 168 as well as along the rear panel 38. The glue seam 26' also includes a relief cutout 170, which makes it easier to close the top of the assembled cooler pack 10'. A second upper hinge line 172 extends between the first side panel tuckable flap 160 and the front panel top flap 162. A third upper hinge line 174 extends between the front panel top flap 162 and the second side panel tuckable flap 164. A fourth upper hinge line 176 extends between the second side panel tuckable flap 164 and the rear panel top flap 166.

In the embodiment illustrated in FIG. 11, the front panel top flap 162 has a first fold-in handle panel 110' defined by a handle panel hinge line 112' and a first handle panel score line 114'. Similarly, the rear panel top flap 166 has a second fold-in handle panel 116' defined by a second handle panel hinge line 118' and a second handle panel score line 120'.

Continuing to refer to FIG. 11, a first plurality of fold lines are formed in the first side panel tuckable flap 160 to facilitate closing of and reclosable locking of the otherwise open top of the cooler pack 10'. The first plurality of fold lines includes a first oblique fold line 178, a second oblique fold line 180, a first tuck-assist fold line 182, a second tuck-assist fold line 184, and a third tuck-assist fold line 186. The first oblique fold line 178 extends from a corner of the first side panel tuckable flap 160 to the midpoint of the upper edge of the first side panel tuckable flap 160. The second oblique fold line 180 extends from a different corner of the first side panel tuckable flap 160 to the same location along the midpoint of the upper edge of the first side panel tuckable flap 160. The third tuck-assist fold line 186 perpendicularly intersects and joins the first tuck-assist fold line 182 and the second tuck-assist fold line 184, as shown in FIG. 11.

The second side panel tuckable flap 164 similarly includes a second plurality of fold lines that facilitate closure and reclosable locking of the top of the cooler pack 10'. The second plurality of fold lines includes a third oblique fold line 188, a fourth oblique fold line 190, a fourth tuck-assist fold line 192, a fifth tuck-assist fold line 194, and a sixth tuck-assist fold line 196. The third oblique fold line 188 extends from a corner of the second side panel tuckable flap 164 to the midpoint of the upper edge of the second side panel tuckable flap 164. The fourth oblique fold line 190 extends from a different corner of the second side panel tuckable flap 164 to the same midpoint position along the upper edge of the second side panel tuckable flap 164. The fourth tuck-assist fold line 192 extends substantially parallel to the fifth tuck-assist fold line 194, and the fourth and fifth tuck-assist fold lines 192, 194 are substantially the same length. The sixth tuck-assist fold line 196 perpendicularly intersects and joins the fourth tuck-assist fold line 192 to the fifth tuck-assist fold line 194.

The first side panel 32' of the blank 12' includes a first side panel slot 198 from which the blank material has been completely removed. Similarly, the second side panel 36' includes a second side panel slot 200 from which the blank material has been completely removed. As an alternative to cutout section slots 198, 200 in the blank 12', slits or perforations etc. forming knockout sections, for example, can be formed in the panels 32, 38.

A liquid-impervious barrier film (an exemplary barrier film 122 is illustrated in FIG. 2) may be affixed to an interior surface of the blank 12' that will become an interior surface of the formed cooler pack 10'. The barrier film can be secured to the surface by, for example, glue, other adhesives, and by other means, in a manner similar to the configuration illustrated in FIG. 2. The barrier film can be formed from, for example, a liquid-tight material. The blank 12' and barrier film can be formed into a partially assembled cooler pack article having a fluid-impervious vessel, similar to the partially assembled cooler pack article 11 illustrated in FIG. 3. The bottom 80 of the cooler pack article may be closed, for example, using the exemplary method illustrated in FIGS. 4-7.

Figure 12:
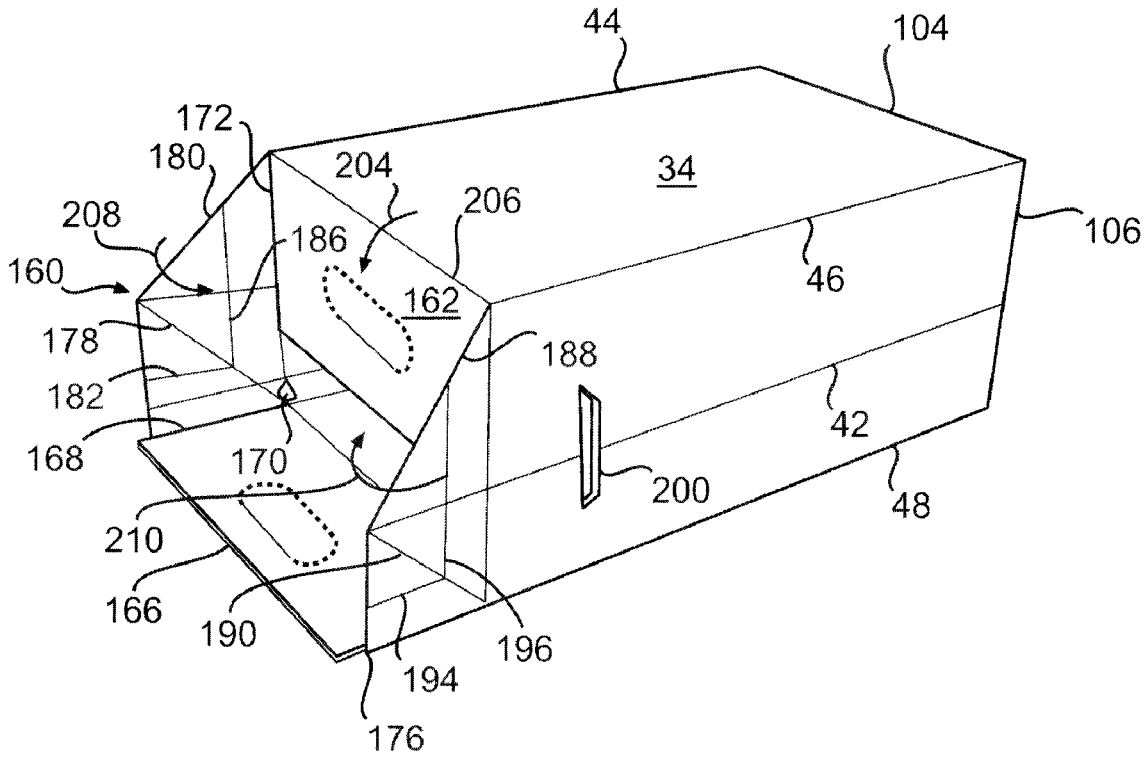
FIGS. 12-14 illustrate a method for forming the cooler pack according to the second embodiment of the invention.
Figure 13:
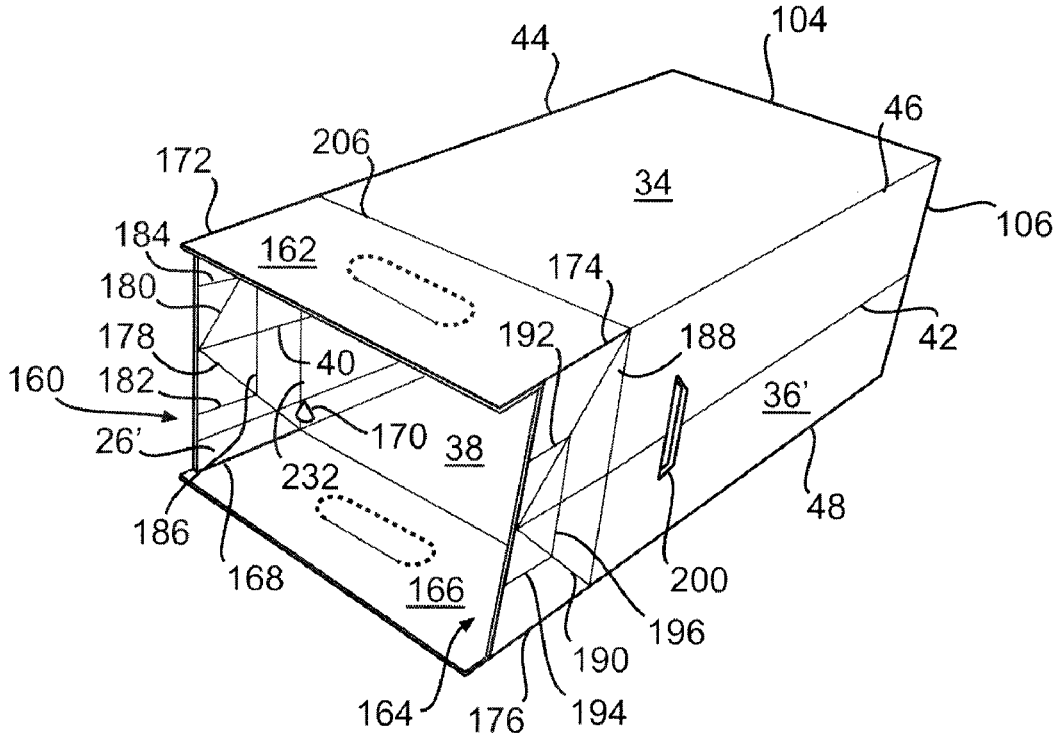

FIGS. 12-15 illustrate an exemplary method of closing of the webbed-top closure 158 of the cooler pack 10' formed using the second blank 12'. Referring to FIG. 12, the bottom 80 of the cooler pack has already been closed (e.g., following the steps illustrated in FIGS. 4-7). Referring also to FIG. 13, the upper edge 202 (see also FIG. 11) of the relief cutout 170 extends along the first oblique fold line 178 when the glue seam 26' is affixed to the inner surface of the first side panel 32' adjacent to the first side panel free edge 14. To close the top of the cooler pack, the front panel top flap 162 is folded downwardly in the direction of the arrow 204 while the first side panel tuckable flap 160 is folded along the second oblique fold line 180 in the direction of the arrow 208. This fold causes folding along the second upper hinge line 172, while the second side panel tuckable flap 164 is folded along the third oblique fold line 188 in the direction of the arrow 210, which in turn causes folding along the third upper hinge line 174.

Figure 14:
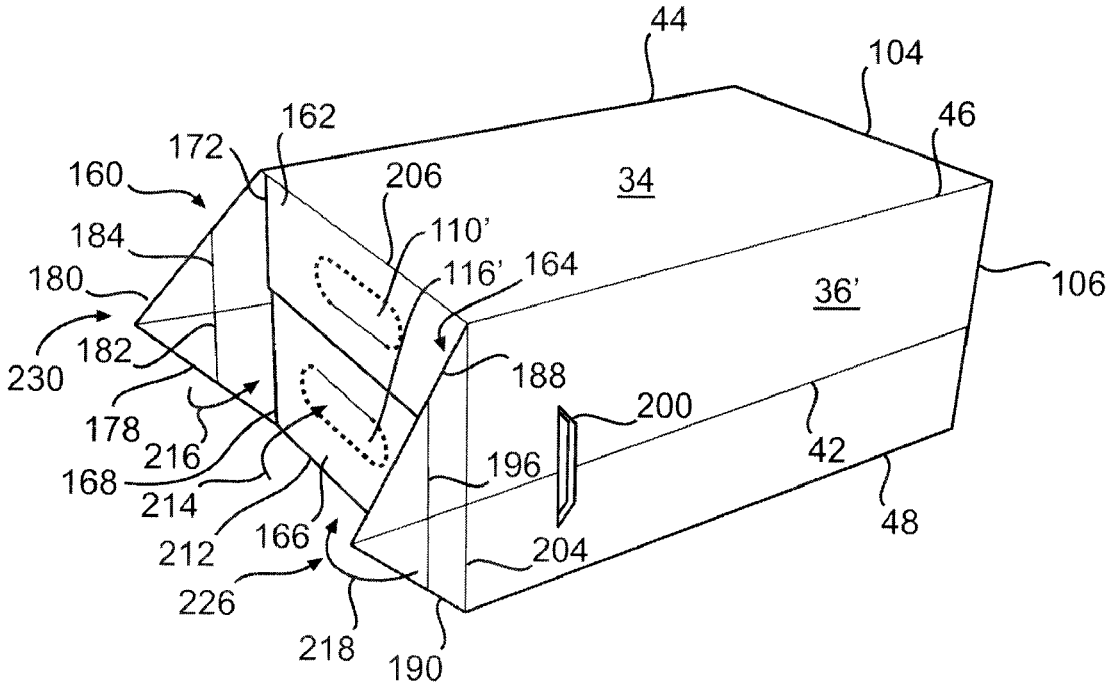

Referring to FIG. 14, corresponding folds are then made along the rear panel top flap hinge line 212 in the direction of arrow 214, the first upper hinge line 168, the fourth upper hinge line 176, the first oblique fold line 178 in the direction of arrow 216, and the fourth oblique fold line 190 in the direction of arrow 218. When these five folds are complete, the cooler pack has the configuration illustrated in FIG. 14.

Figure 15:
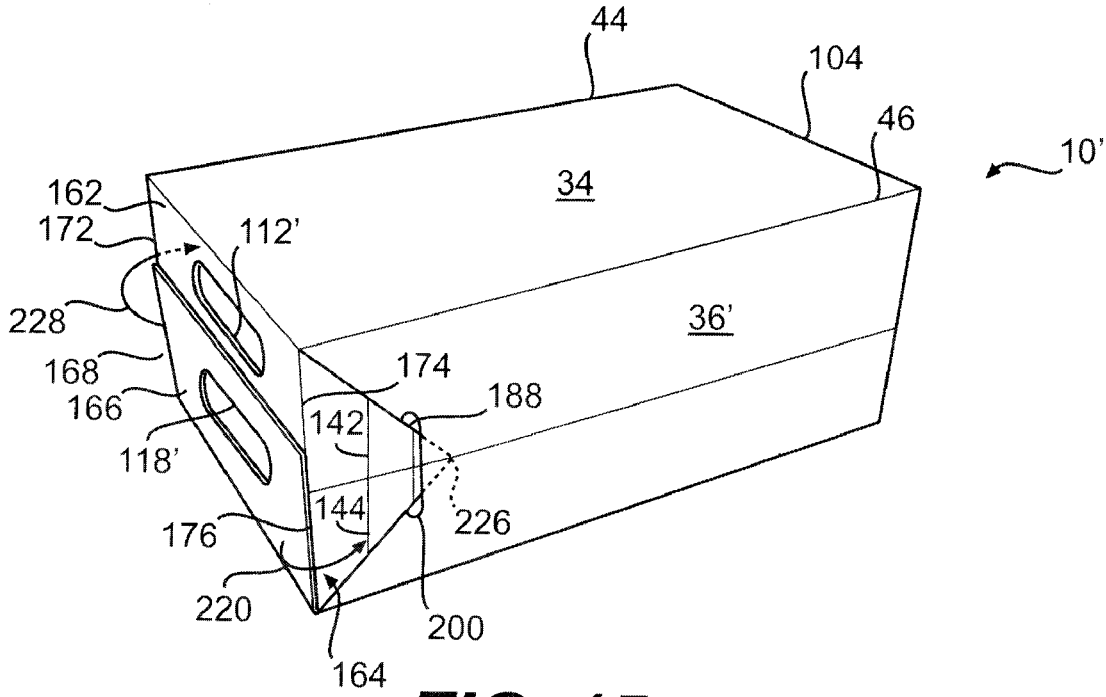
FIG. 15 illustrates the cooler pack according to the second embodiment of the invention.

Referring to FIGS. 14 and 15, to complete closing and reclosable locking of the top, the second side panel tuckable flap 164, which now has a triangular configuration, is folded back in the direction of arrow 220 along the third upper hinge line 174, the fourth upper hinge line 176, and a second tuckable flap lower hinge line 224, a tip 226 of the second side panel tuckable flap 164 may be inserted into the second side panel slot 200 as shown in FIG. 15. Similarly, the now triangular-shaped first side panel tuckable flap 160 is folded in the direction of arrow 228 until a tip 230 of the first side panel tuckable flap 160 is folded toward the first side panel 32' along the first upper hinge line 168, the second upper hinge line 172, and a first tuckable flap lower hinge line 232 (shown in FIG. 12) so that the tip 230 of the first side panel tuckable flap 160 may be inserted into the first side panel slot 198 (shown in FIG. 11). Insertion of the tip 230 of the first side panel tuckable flap 160 into the first side panel slot 19 is not visible in FIG. 15. With the top of the cooler pack 10' closed, the cooler pack 10' has a generally parallelepipedal shape.

In order to facilitate insertion of the tips 230, 226 of the first and second side panel tuckable flaps 160, 164 into the first and second side panel slots 198, 200, respectively, the tuck-assist fold lines are implicated. For example, in order to insert the tip 226 of the second side panel tuckable flap 164 into the second side panel slot 200, as shown in FIG. 15, the triangularly-shaped (see FIGS. 14 and 15) second side panel tuckable flap 164 may be folded slightly along the fourth, fifth, and sixth tuck-assist fold lines 192, 194, 196. When the second side panel tuckable flap 164 is in the configuration illustrated in FIGS. 14 and 15, the sixth tuck-assist fold line 196 is directly on top of the fourth and fifth tuck-assist fold lines 192, 194. This makes it easier to initiate insertion of the tip 226 of the second side panel tuckable flap 164 into the second side panel slot 200. Similarly, the first side panel tuckable flap 160 includes a first tuck-assist fold line 182, a second tuck-assist fold line 184, and a third tuck-assist fold line 186 so that the tip 230 of the first side panel tuckable flap 160 may be more easily inserted into the first side panel slot 198. When the first side panel tuckable flap 160 is in the configuration illustrated in FIGS. 14 and 15, the third tuck-assist fold line 186 is directly on top of the first and second tuck-assist fold lines 182, 184.

With the cooler pack 10' in the fully-closed configuration illustrated in FIG. 15, the first and second fold-in handle panels 110', 116' may be pressed inwardly to allow the consumer to carry the fully assembled and closed cooler pack 10' by its top.

The liquid-impervious material used to form the barrier films discussed in this specification can be formed from, for example, ComposiGard® or Integra Pak®, both of which are available from Graphic Packaging Corporation of Golden, Colo. Other suitable materials include ethylene vinyl alcohol (EVOH), ethylene vinyl acetate (EVA), polyethylene (PET), and polyvinyl dichlorides (e.g., SARAN®). Other materials could also be used for the barrier film 122.

All directional references (e.g., upper, lower, upward, downward, left, right, leftward, rightward, top, bottom, above, below, vertical, horizontal, clockwise, and counter-clockwise) are only used for identification purposes to aid the reader's understanding of the present invention, and do not create limitations, particularly as to the position, orientation, or use of the invention.

In the exemplary embodiments discussed above, the blanks may be formed from, for example, paperboard, clay coated newsprint (CCN), solid unbleached sulfate board (SUS. The blanks can also be constructed of other materials, such as cardboard, or any other material having properties suitable for enabling the cooler pack to function at least generally as described above.

The blanks according to the present invention can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure paperboard carton panels in place.

The term "line" as used herein includes not only straight lines, but also other types of lines such as curved, curvilinear or angularly displaced lines.

In accordance with the exemplary embodiments, a fold line or hinge line can be any substantially linear, although not necessarily straight, form of weakening that facilitates folding therealong. More specifically, but not for the purpose of narrowing the scope of the present invention, fold lines include: score lines, such as lines formed with a blunt scoring knife, or the like, which creates a crushed or depressed portion in the material along the desired line of weakness; cuts that extend partially into a material along a desired line of weakness, and/or a series of cuts that extend partially into and/or completely through the material along the desired line of weakness; and various combinations of these features.

It will be understood by those skilled in the art that while the present invention has been discussed above with reference to preferred embodiments, various additions, modifications, and variations can be made thereto without departing from the spirit and scope of the present invention as set forth in the following claims.

What is claimed is:

1. A collapsible cooler pack, comprising:

a blank including a plurality of bottom flaps and a plurality of panels, wherein each bottom flap of the plurality of bottom flaps includes opposite proximal and distal ends, the proximal ends of the bottom flaps are respectively connected to bottom ends of panels of the plurality of panels, so that the distal ends of the bottom flaps are spaced apart from the bottom ends of the panels, the plurality of panels defines an interior surface of the blank, which extends around an interior of the collapsible cooler pack, and the plurality of panels includes a first side panel, a second side panel, a front panel, and a rear panel, wherein the first side panel is bisected by a first fold line, and the second side panel is bisected by a second fold line;

at least one handle in a panel selected from the group consisting of the first side panel, the second side panel, the front panel and the rear panel;

a first side panel top flap;

a front panel top flap;

a second side panel top flap;

a rear panel top flap; and a barrier film attached to at least a portion of the interior surface of the blank, wherein the barrier film is formed into a vessel that is for retaining fluid, the vessel includes opposite top and bottom ends, the top end of the vessel defines an opening for accessing an interior of the vessel, the bottom end of the vessel is closed, the closed bottom end of the vessel extends outwardly from the interior of the collapsible cooler pack and past the distal ends of the bottom flaps, so that a distance that the closed bottom end of the vessel is spaced apart from the bottom ends of the panels is greater than how far the distal ends of the bottom flaps are spaced apart from the bottom ends of the panels, and in a side elevation view of the collapsible cooler pack in an upright configuration, the vessel, including the top end of the vessel, is positioned below the at least one handle, so that the barrier film does not obstruct the at least one handle.

2. The collapsible cooler pack of claim 1, wherein a closing tab extends from the rear panel top flap and a corresponding closing tab slot is formed in the front panel top flap.

3. The collapsible cooler pack of claim 1, wherein:

the first side panel top flap is a first side panel tuckable flap; and the second side panel top flap is a second side panel tuckable flap.

4. The collapsible cooler pack of claim 3, further comprising:

a first plurality of fold lines formed in the first side panel tuckable flap; and a second plurality of fold lines formed in the second side panel tuckable flap.

5. The collapsible cooler pack of claim 4, wherein the first plurality of fold lines comprises a first oblique fold line, a second oblique fold line, a first tuck-assist fold line, a second tuck-assist fold line, and a third tuck-assist fold line.

6. The collapsible cooler pack of claim 5, wherein the second plurality of fold lines comprises a third oblique fold line, a fourth oblique fold line, a fourth tuck-assist fold line, a fifth tuck-assist fold line, and a sixth tuck-assist fold line.

7. The collapsible cooler pack of claim 6, wherein the first side panel includes a first side panel slot, and wherein the second side panel includes a second side panel slot.

8. A method of assembling the collapsible cooler pack of claim 1, comprising:

attaching the barrier film to the interior surface of the blank;

thereafter forming the barrier film into the vessel, wherein the forming of the barrier film into the vessel comprises sealing at least one edge of the barrier film so that the barrier film forms the vessel; and thereafter closing a bottom of the collapsible cooler pack with the bottom flaps.

9. The method of claim 8, wherein the method comprises closing a top of the cooler pack with the top flaps, and the cooler pack has a generally parallelepipedal shape.

10. The method of claim 8, wherein the first side panel is folded at the first fold line in the first side panel, and the second side panel is folded at the second fold line in the second side panel.

11. The method of claim 10, wherein the collapsible cooler pack is folded substantially flat at the first and second fold lines.

12. The method of claim 8, wherein sealing the at least one edge of the barrier film includes sealing a bottom edge of the barrier film.

13. The method of claim 12, further comprising closing a top of the cooler pack with the top flaps at a top of the blank.

14. The method of claim 13, wherein:

the first side panel top flap is a first side panel tuckable flap; and the second side panel top flap is a second side panel tuckable flap.

15. A method of use of the collapsible cooler pack of claim 1, comprising:

forming a cooler pack from the collapsible cooler pack;

thereafter loading a plurality of beverages into the vessel;

thereafter loading ice into the vessel;

thereafter removing the plurality of beverages from the cooler pack;

thereafter removing the ice and/or water formed from melting of the ice from the cooler pack; and thereafter collapsing the cooler pack for reuse.

16. The method of claim 15, wherein the method comprises closing a top of the cooler pack with the top flaps, and the cooler pack has a generally parallelepipedal shape.

17. The method of claim 15, wherein the collapsible cooler pack is folded substantially flat.

18. A cooler pack article, comprising:

a blank, the blank comprising:

a plurality of bottom flaps;

a first side panel;

a second side panel;

a front panel;

a rear panel;

at least one handle in a panel selected from the group consisting of the first side panel, the second side panel, the front panel and the rear panel; and a barrier film attached to at least a portion of an interior surface of the blank, wherein the barrier film is formed into a bag capable of retaining liquid, the bag includes opposite top and bottom ends, the bottom end of the bag is closed, the top end of the bag defines an opening for accessing an interior of the bag, and in a side elevation view of the cooler pack article in an upright configuration, the bag, including the top end of the bag, is positioned below the at least one handle, so that the barrier film does not obstruct the at least one handle.

19. The cooler pack article of claim 18, wherein the barrier film includes at least one sealed edge.

20. The cooler pack article of claim 19, wherein the at least one sealed edge of the bag includes a bottom edge of the barrier film.

21. The cooler pack article of claim 18, wherein the cooler pack article is folded substantially flat.

22. The cooler pack article of claim 21, wherein the first side panel is folded at a first fold line in the first side panel, and the second side panel is folded at a second fold line in the second side panel.

23. The cooler pack article of claim 18, further comprising:

a first side panel tuckable flap;

a front panel top flap;

a second side panel tuckable flap; and a rear panel top flap.

24. The cooler pack article of claim 18, further comprising:

a first side panel top flap;

a front panel top flap;

a second side panel top flap; and a rear panel top flap.

* * * * *